US012259140B2

(12) United States Patent
Rehage et al.

(10) Patent No.: US 12,259,140 B2
(45) Date of Patent: Mar. 25, 2025

(54) BAKING OVEN

(71) Applicant: Paul Hettich GmbH & Co. KG, Kirchlengern (DE)

(72) Inventors: Daniel Rehage, Chemnitz (DE); Johann Braun, Hiddenhausen (DE); Johann-Sebastian Lessmann, Kirchlengern (DE); Christian Redikop, Bad Oeynhausen (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 878 days.

(21) Appl. No.: 17/048,188

(22) PCT Filed: Mar. 5, 2019

(86) PCT No.: PCT/EP2019/055422

§ 371 (c)(1),
(2) Date: Oct. 16, 2020

(87) PCT Pub. No.: WO2019/201502

PCT Pub. Date: Oct. 24, 2019

(65) Prior Publication Data

US 2021/0381695 A1 Dec. 9, 2021

(30) Foreign Application Priority Data

Apr. 19, 2018 (DE) ..... 10 2018 109 429.9

(51) Int. Cl.
*F24C 15/16* (2006.01)

(52) U.S. Cl.
CPC ..... *F24C 15/168* (2013.01)

(58) Field of Classification Search
CPC ..... F24C 15/16; F24C 15/162; A47J 37/049; A47J 37/04; A47J 37/0694; A47J 37/067; A47J 211/94; A47J 211/90; A47J 211/126; A47J 211/162
See application file for complete search history.

(56) References Cited

U.S. PATENT DOCUMENTS 2,576,252 A * 11/1951 Conner ..... F24C 15/162
9,939,160 B2 4/2018 Kim et al.
(Continued)

FOREIGN PATENT DOCUMENTS

CN 103002772 A1 * 3/2013 ..... A47B 88/43
DE 2242434 A1 3/1974
(Continued)

OTHER PUBLICATIONS

Machine translation of DE 102014217633 A1 performed on Jul. 11, 2024, Dinkel et al. (Year: 2016).*
(Continued)

*Primary Examiner* — Reginald Alexander
*Assistant Examiner* — Kevin Guanhua Wen
(74) *Attorney, Agent, or Firm* — Collard & Roe, P.C.

(57) ABSTRACT

A baking oven has a baking oven muffle, on which at least one pull-out guide is arranged. Each pull-out guide has a stationary guide rail and a movable running rail, wherein one or two side grids with at least one receptacle for a cooking good carrier is or are held on the running rail. The carrier is arranged between two of the side grids.

15 Claims, 12 Drawing Sheets

(56) References Cited

U.S. PATENT DOCUMENTS

Figure 1A:
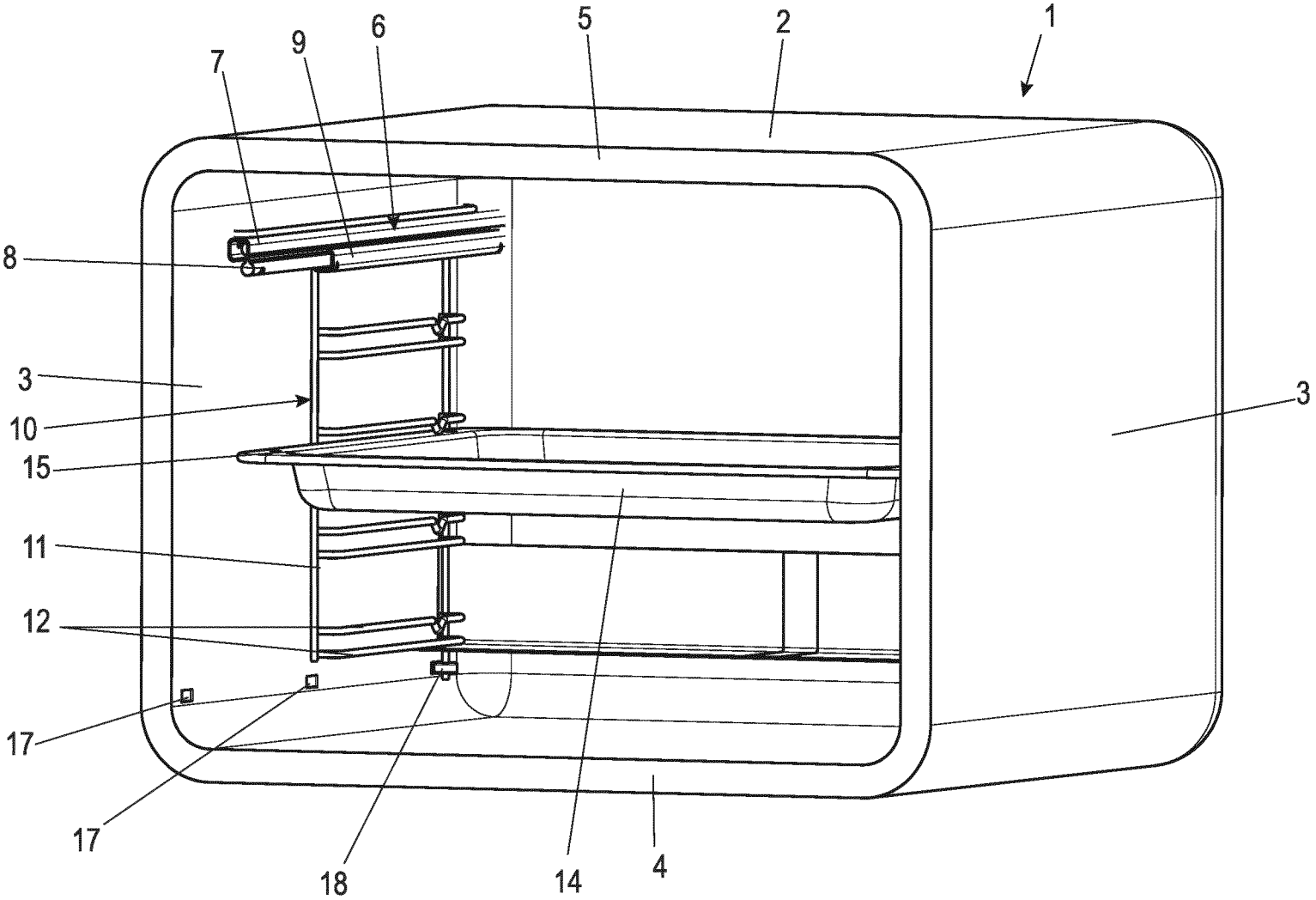

| | | | | |
|---|---|---|---|---|
| 2005/0241495 | A1* | 11/2005 | Feldmann et al. | A47J 9/00 99/448 |
| 2006/0266349 | A1* | 11/2006 | Beck et al. | F24C 15/16 126/339 |
| 2010/0218755 | A1* | 9/2010 | Stewart et al. | F24C 15/16 126/339 |
| 2012/0248955 | A1* | 10/2012 | Rehage et al. | F24C 15/16 312/334.1 |
| 2019/0049120 | A1 | 2/2019 | Lormehs et al. | |

FOREIGN PATENT DOCUMENTS

| | | | | |
|---|---|---|---|---|
| DE | 2352889 | A1 | 4/1975 | |
| DE | 7505695 | U | 8/1975 | |
| DE | 2508005 | A1 | 9/1976 | |
| DE | 7708782 | U1 | 9/1977 | |
| DE | 3815440 | A1 | 11/1989 | |
| DE | 4014823 | A1 | 11/1991 | |
| DE | 4236740 | A1 | 5/1994 | |
| DE | 10241488 | A1 | 1/2004 | |
| DE | 10240146 | A1 | 3/2004 | |
| DE | 102005019956 | A1 | 11/2006 | |
| DE | 102012100454 | A1 | 7/2013 | |
| DE | 102014217633 | A1 * | 3/2016 | A47L 15/507 |
| EP | 2236941 | A1 * | 10/2010 | F24C 15/162 |
| EP | 2908056 | A2 * | 8/2015 | F24C 15/168 |
| EP | 2960584 | A1 * | 12/2015 | F24C 15/16 |
| WO | WO 2004020908 | A2 * | 3/2004 | |

OTHER PUBLICATIONS

Machine translation of CN 103002772 A1 performed on Jul. 12, 2024, Reidt (Year: 2013).*

Machine translation of EP 2908056 A2 performed on Jul. 12, 2024, Hahn et al. (Year: 2015).*

International Search Report dated May 23, 2019 issued in PCT/EP2019/055422 (with English translation).

German Search Report dated Jan. 8, 2019 issued in the corresponding German Application No. 10 2018 109 429.9 (with English translation).

European Office Action mailed on Sep. 15, 2021 issued in the corresponding EP Application Serial No. 19 709 789.1 (with English translation of relevant parts).

Hearing Notice of the Indian Patent Office mailed on Jan. 19, 2024 issued in the corresponding Application Serial No. 202047049834.

* cited by examiner

BAKING OVEN

CROSS REFERENCE TO RELATED APPLICATIONS

This application is the National Stage of PCT/EP2019/055422 filed on Mar. 5, 2019, which claims priority under 35 U.S.C. § 119 of German Application No. 10 2018 109 429.9 filed on Apr. 19, 2018, the disclosures of which are incorporated by reference. The international application under PCT article 21(2) was not published in English.

BACKGROUND

The present invention relates to a baking oven with a baking oven muffle, on which at least one pull-out guide is arranged, each of which has a stationary guide rail and a movable running rail, wherein one or two side grids with at least one receptacle for a cooking good carrier is or are held on the running rail, which carrier is arranged between two side grids.

There are ovens in which a cooking good carrier is movably held on pull out guides which are fixed in an oven muffle on opposite sides via side grids. Such cooking good carrier can be easily moved in front of the oven muffle, but the cooking good carrier is only loosely supported and not secured against unintentional lifting. There is also the disadvantage that when the cooking good carrier is removed, the running rails of the pull-out guide protrude comparatively far in front of the oven muffle and pose a risk of injury.

In order to make the guidance of a cooking good carrier safer, baking trolleys are known which are arranged on both sides or, according to DE 10 2005 019 956 A1, on one side. In such baking trolleys, a cooking good carrier can be securely fixed to a support, although here too there is the problem that when the cooking good carrier is removed, the baking trolley protrudes comparatively far from the oven muffle and presents a risk of injury. If the baking trolleys are arranged on both sides, the cooking good carrier can only be removed from the front, as the side grids extend over the entire length of the cooking good carrier. With baking trolleys arranged on one side, the cooking good carrier must be lifted out of the holder from the other side. This requires a great deal of force when the cooking good carrier is heavily loaded. In addition, with baking trolleys arranged on two sides, the food can only be checked from the front when the cooking good carrier is fully extended, which allows the food to cool down again and exposes the user to the hot air flowing out of the oven.

SUMMARY OF THE INVENTION

It is therefore the object of the present invention to provide an oven which has improved handling when preparing food on a cooking good carrier.

This object is solved with an oven having the features of claim 1.

The oven according to the invention comprises a cooking good carrier, which is held on opposite sides on side grids, which are supported by a pull-out guide.

The side grids are shorter than the cooking good carrier in a direction parallel to the longitudinal direction of the pull-out guides, so that when the cooking good carrier is pulled out, the side grids protrude less from the oven muffle than the cooking good carrier. This reduces the risk of components protruding from the oven muffle when the cooking good carrier is removed and at the same time provides better access to the food and the cooking good carrier. This makes it possible to grip the cooking good carrier ergonomically on both sides and remove it without much effort. It is also possible to check the food to be cooked from the side without contact with the hot air escaping from the oven.

Preferably, the cooking good carrier can be placed in a middle pull-out position with one front section protruding from the oven muffle, while the two side rails are still completely positioned in the oven muffle. In such a middle pull-out position between the pull-in position and the maximum pull-out position, the cooking good carrier can protrude slightly from the baking oven muffle so that the food on the cooking good carrier can be inspected during preparation or the cooking good carrier can be removed from the side rail without the side rails protruding from the baking oven muffle and posing a risk of injury. After removing the cooking good carrier, the side rails can remain in this position until at least one cooking good carrier is picked up again and need not be touched when hot.

The cooking support is preferably at least 20%, and in particular at least 30%, longer in the longitudinal direction than the side rail. The side grid can, for example, be 20% to 80% of the length of the cooking good carrier in the longitudinal direction.

In a further embodiment, latching devices are provided which lock the side rail in a maximum extension position. The latching devices can be provided on the pull-out guide, the side rail or another component. Preferably, the latching devices are formed by springy metal bars or other latching devices which have certain retaining forces to prevent the side rail from moving inadvertently in the latched position. Alternatively or additionally, the side rail can be latched in a middle pull-out position, which is located between the retracted position and the maximum pull-out position. In the middle pull-out position, preferably the side grid is still completely inside the oven muffle, and a front section of the cooking good carrier protrudes from the oven muffle.

For stable guidance, the side grid can be suspended from the running rail on at least one side, preferably on both sides. The stationary guide rail can be arranged above a movable running rail of the pull-out guide. In this way, the pull-out guide is arranged in an upper area that is less accessible for children. Alternatively, the running rail can also be arranged above the guide rail.

In order to be able to move the cooking good carrier preferably completely in front of the oven muffle, the pull out guides preferably have an pull-out-extending middle rail between the stationary guide rail and the running rail.

The running rails and/or the side rails can also be connected to each other by synchronization means to ensure a smooth pull-out movement.

In order to secure the cooking good carrier against tilting, an edge of the cooking good carrier can be arranged between two horizontal bars on at least one side grid. A downward projection on the upper bar can be used to secure the cooking good carrier against tipping.

In a further embodiment, the running rail can be at least 10% shorter in the longitudinal direction than the guide rail. In this case, the side rails and also the running rails can remain arranged inside the oven muffle in a middle pull-out position when the cooking good carrier is removed, so that a door of the oven can be closed.

In an alternative embodiment, the pull-out guide can be moved between a fully inserted state and an extended state in which the front end of the running rail does not or only slightly overlap the front end of the guide rail. This means that the side grid is in both positions inside the oven and the door can always be closed, even when the running rail or side rail is in the front position, if no cooking good carrier is hung in place. After removing the cooking good carrier, it is therefore not necessary to touch the hot pull-out guide to close the door, as is normally necessary.

Preferably, at least one spring element is provided between the oven muffle and the cooking good carrier, which pre-tensions the cooking good carrier in the opening direction when the oven is in a closed position. The spring element does not have to be mounted directly on the muffle and the cooking good carrier, but can also be provided by interposing other components to pretension the cooking good carrier in the opening direction. For example, the spring element can have a detachable or non-detachable effect on a synchronizing device between the two pull-out guides or on a side grid. This means that when the oven is opened, the cooking good carrier can be moved at least partially in the opening direction to make it more easily accessible. The pull-out movement generated by the spring element may, for example, be in the range of 2 cm to 30 cm, in particular 5 cm to 20 cm. The spring element can, for example, be designed as a bending spring which is detachably connected to the cooking good carrier.

The cooking good carrier preferably has at least one stop element made of an elastic material, for example rubber, silicone or another heat-resistant plastic on the side facing the oven door. This allows the pre-tensioned cooking good carrier to touch the oven door in the closed position without any loud banging noises, and when the oven door is opened, the cooking good carrier can be moved in the pull-out direction via the spring element.

The invention is explained in more detail below by means of a design example with reference to the attached drawings. It is shown in:

BRIEF DESCRIPTION OF THE DRAWING FIGURES

Figure 1B:
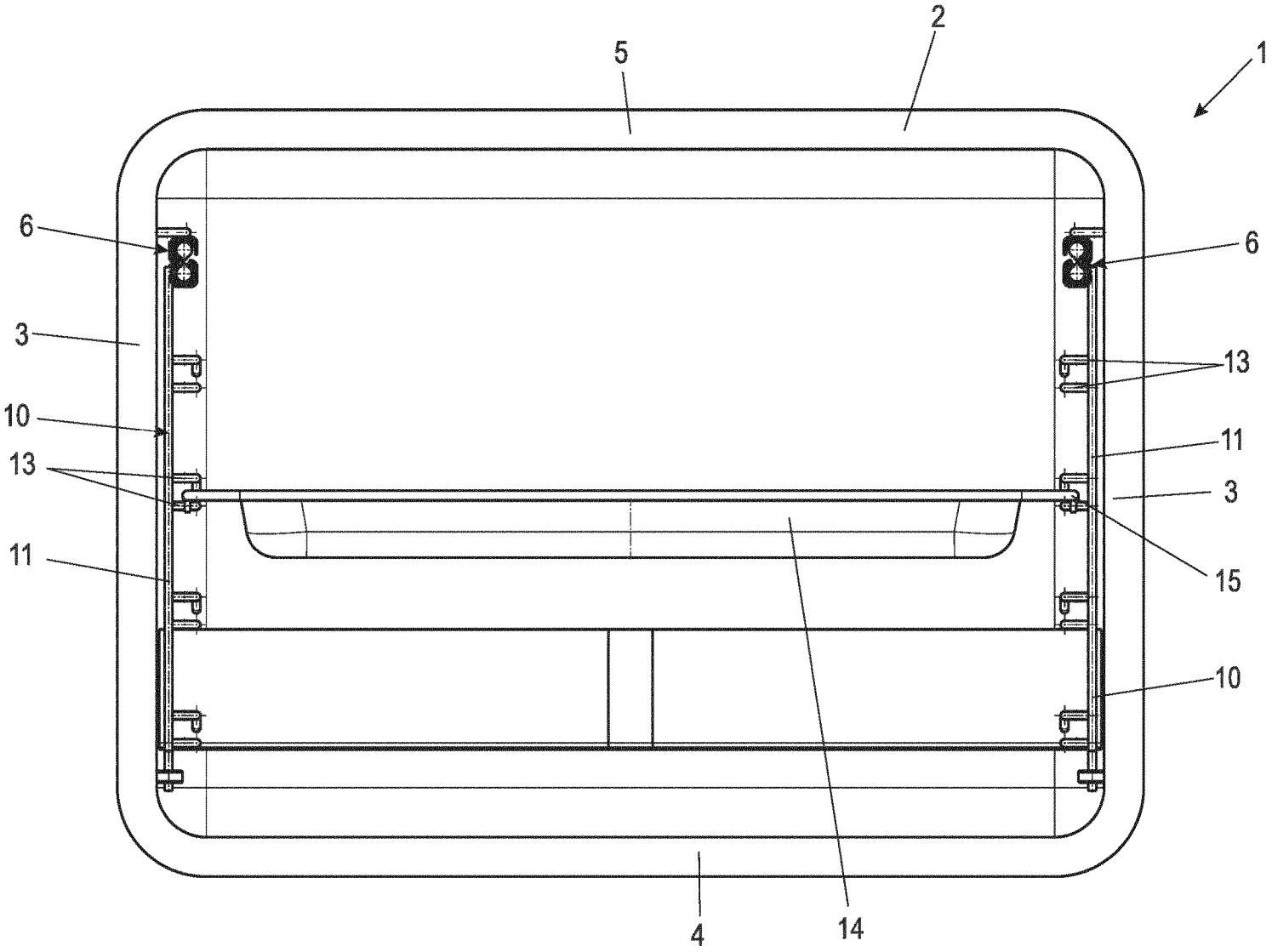
Figure 2A:
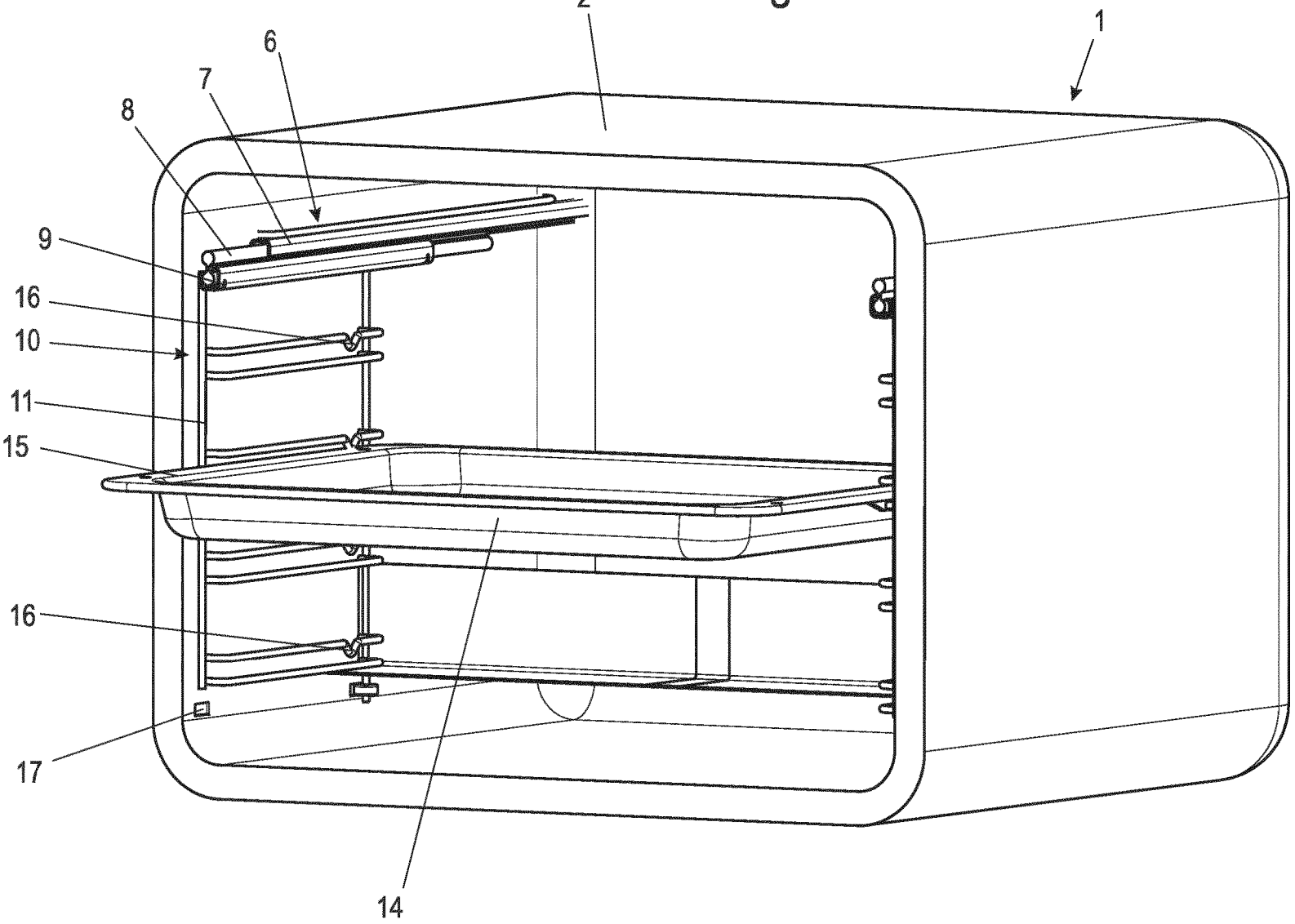
Figure 2B:
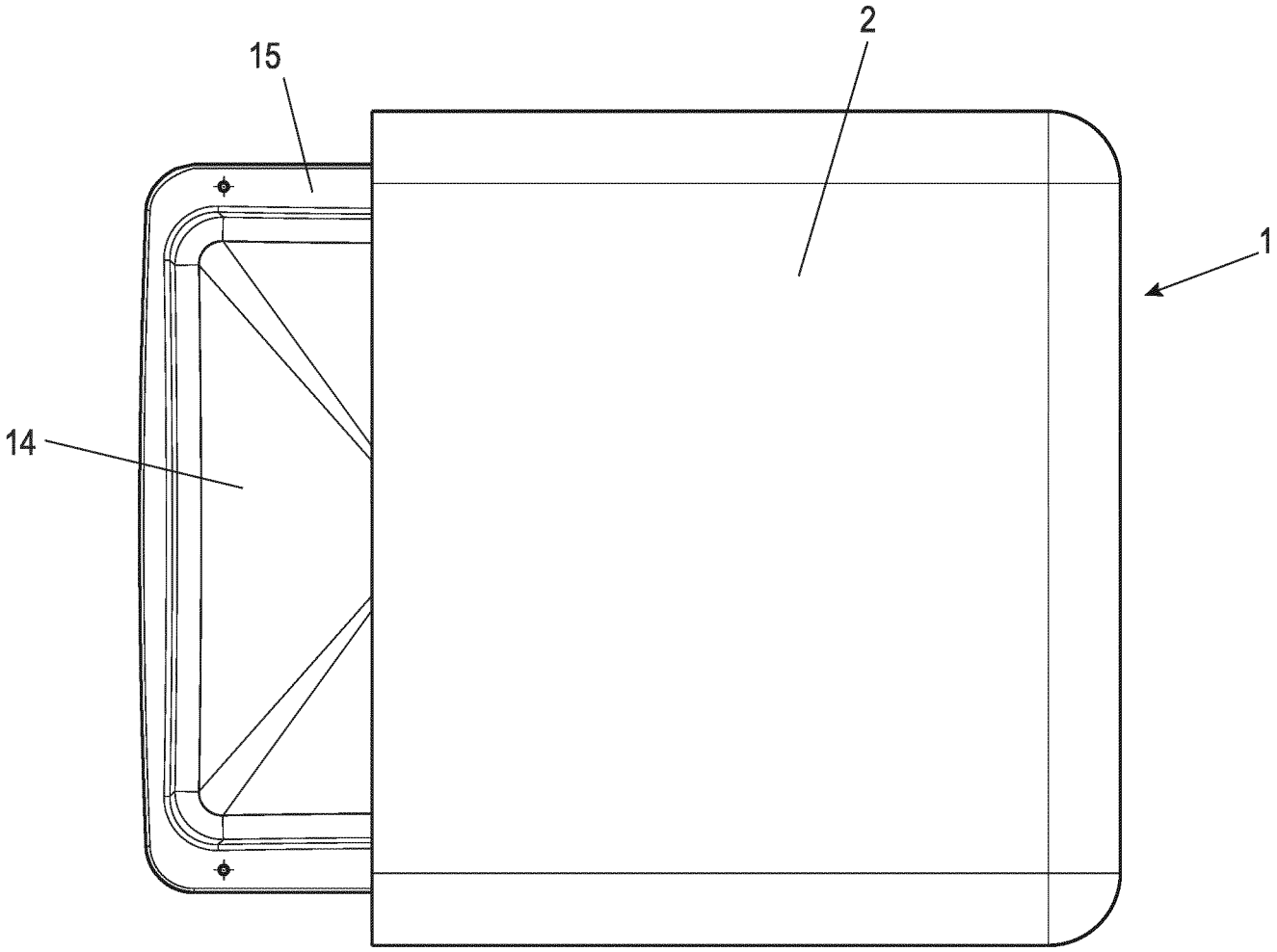
Figure 2C:
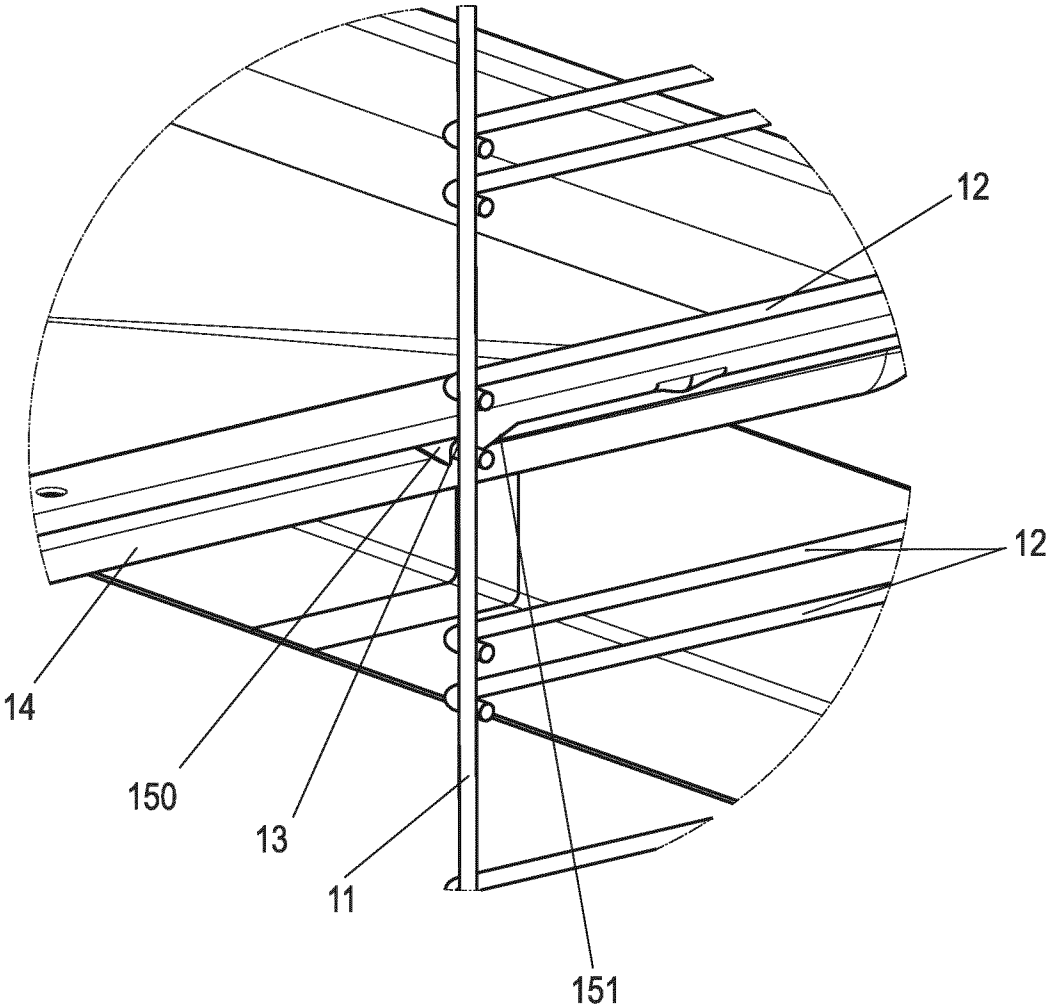
Figure 2D:
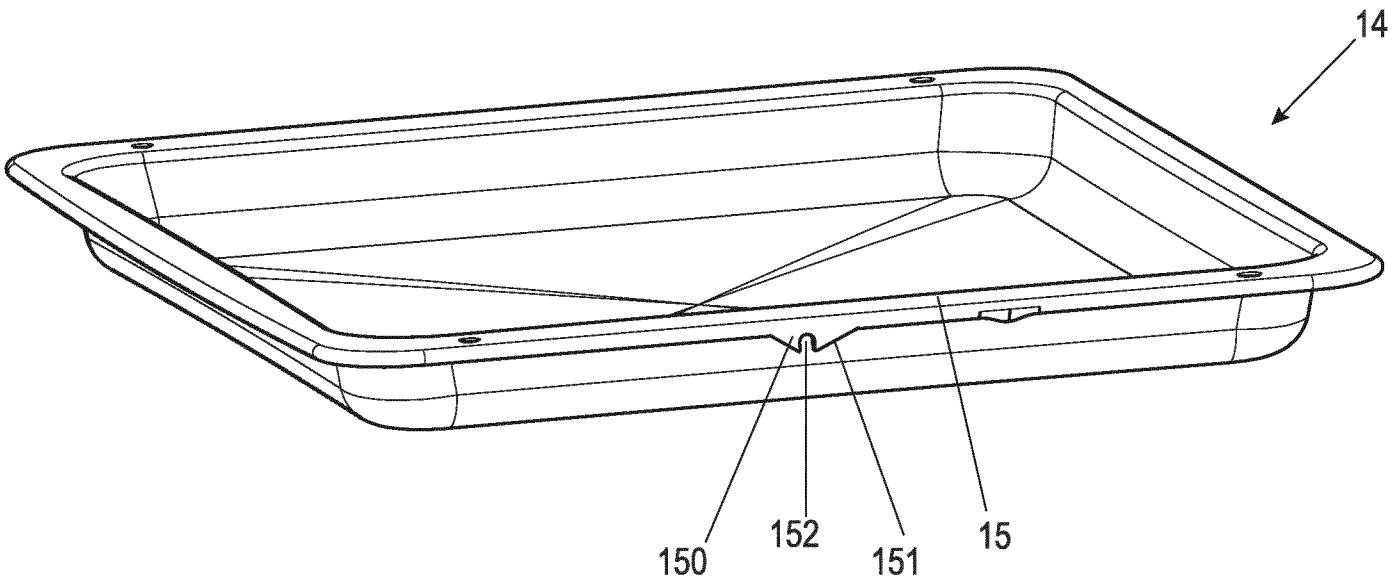
Figure 3A:
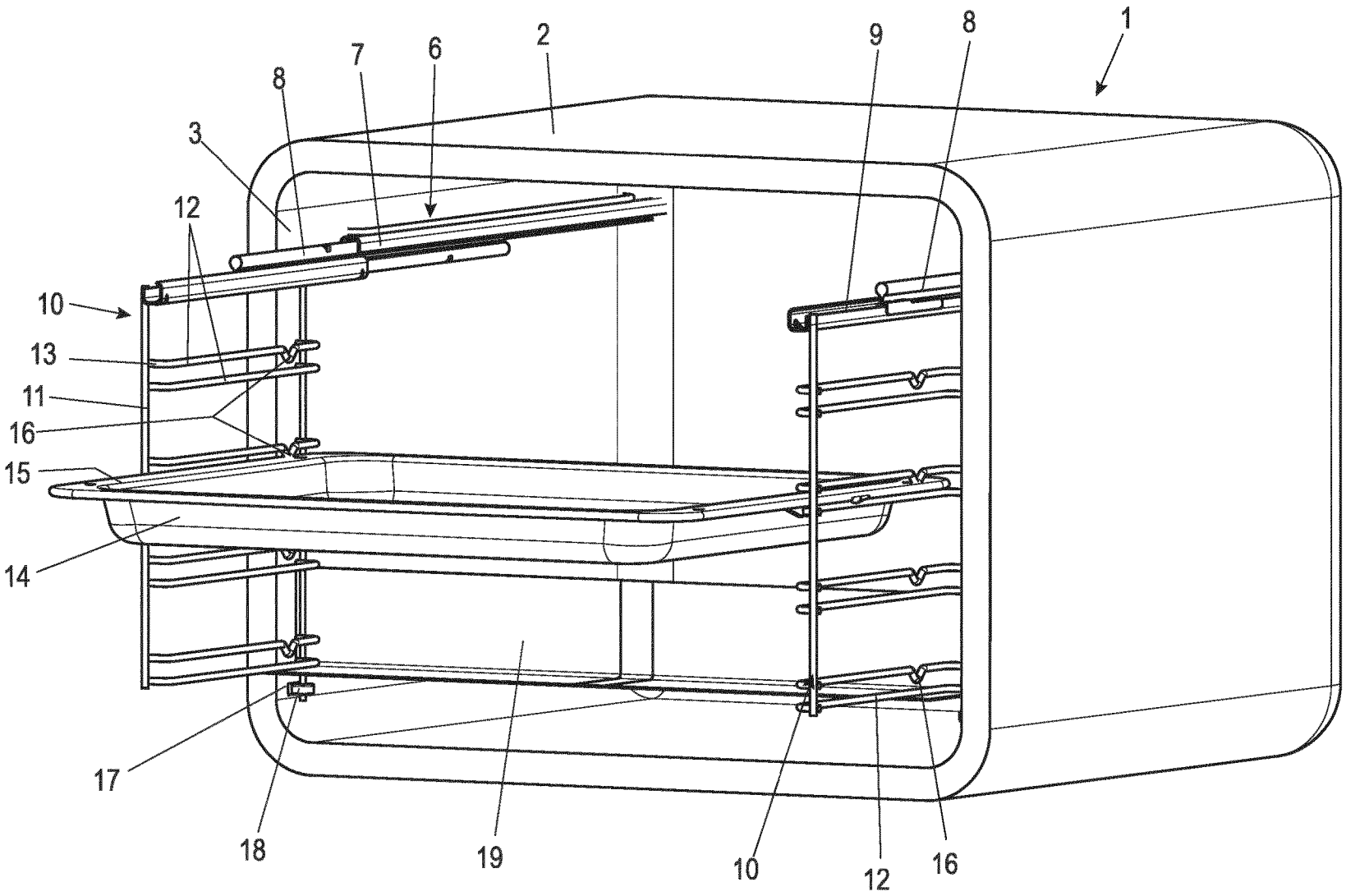
Figure 3B:
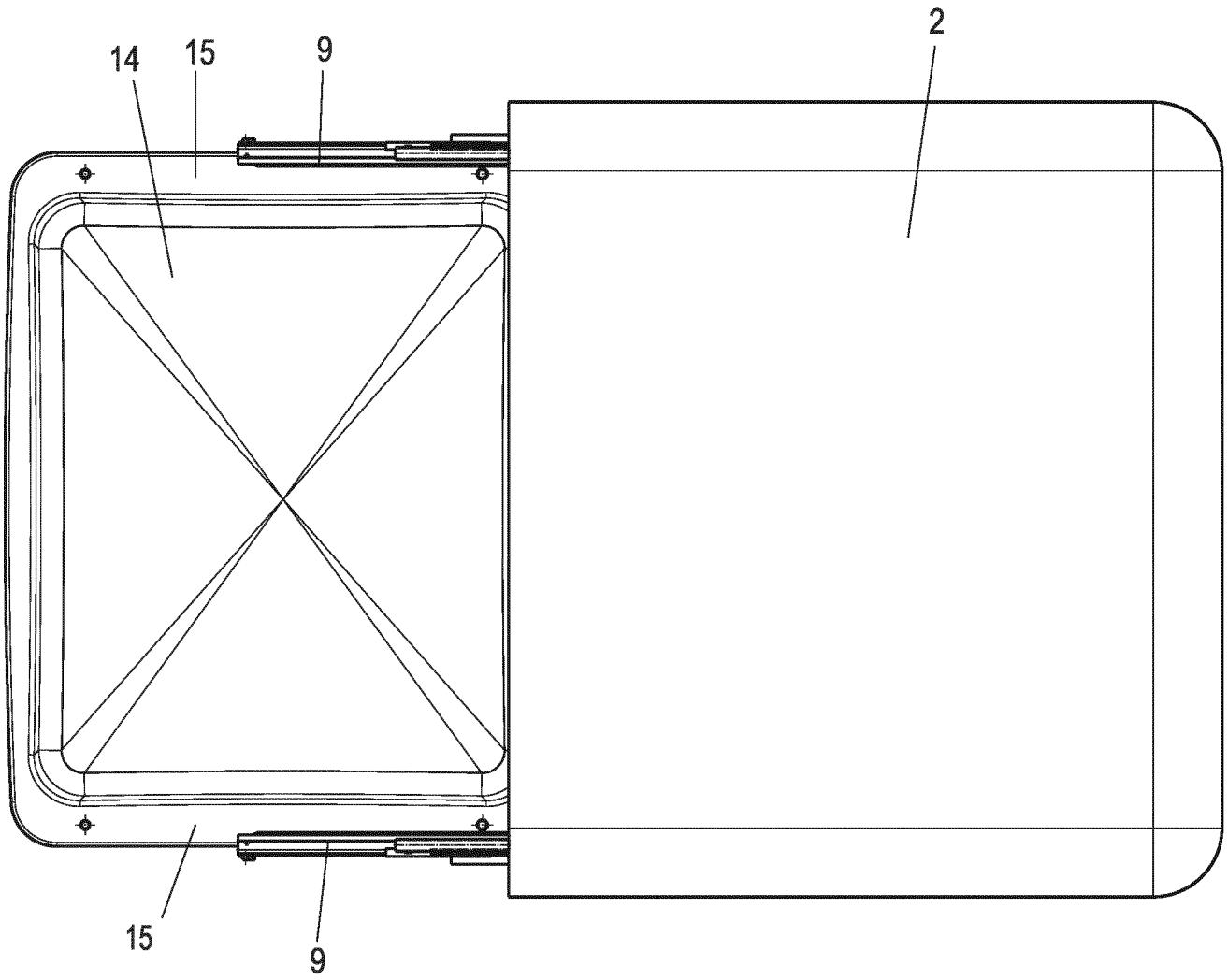
Figure 4A:
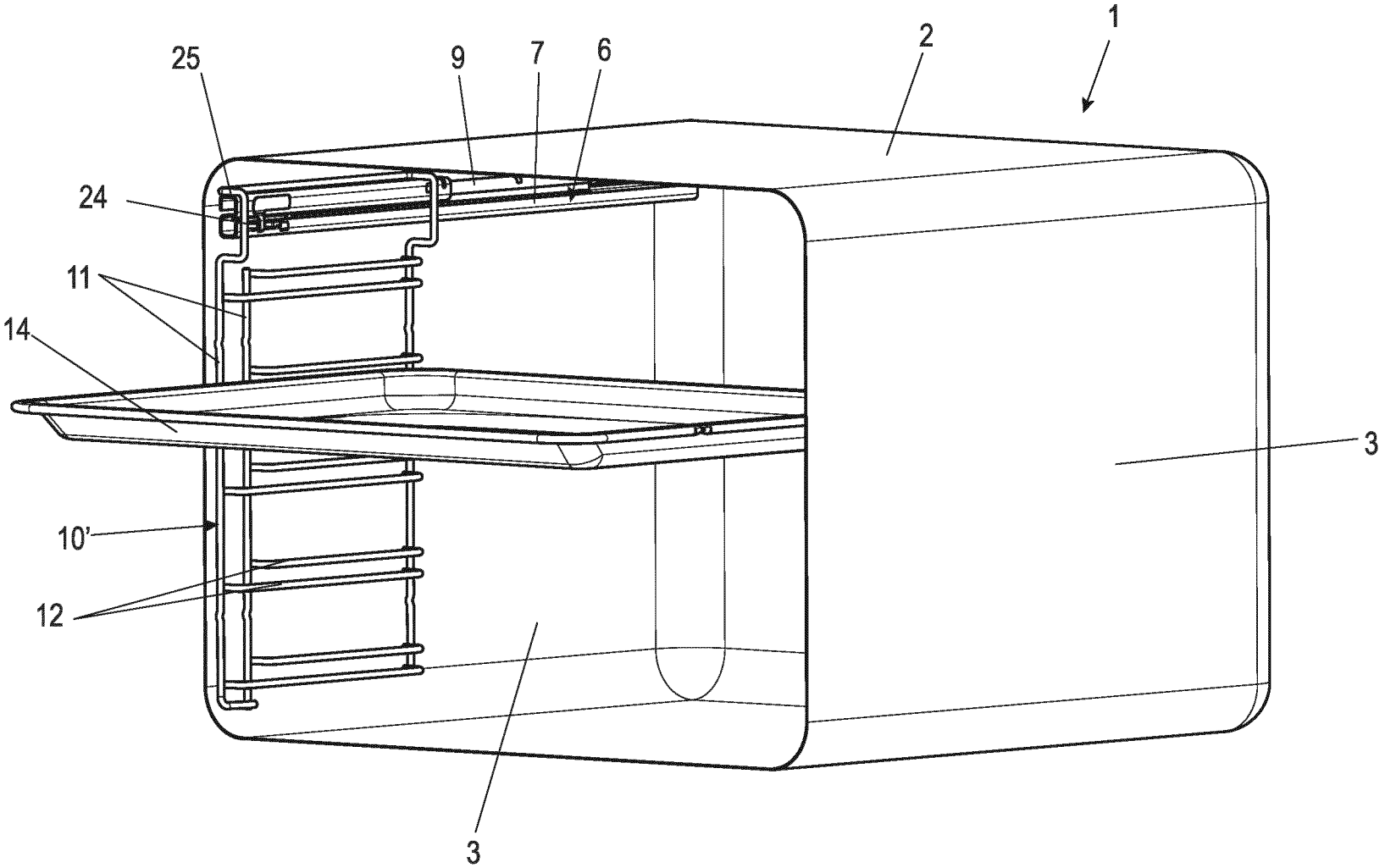
Figure 4B:
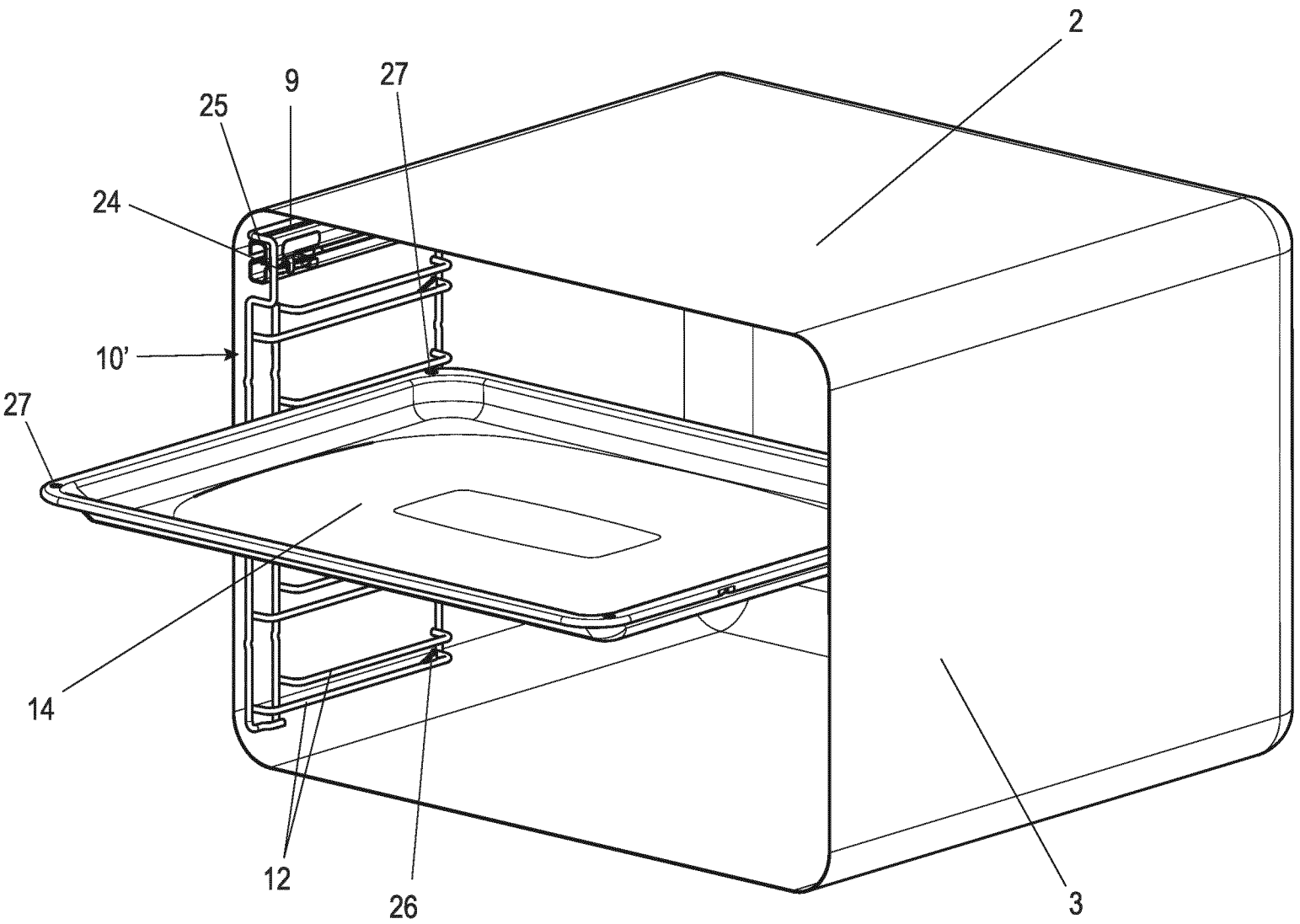
Figure 5:
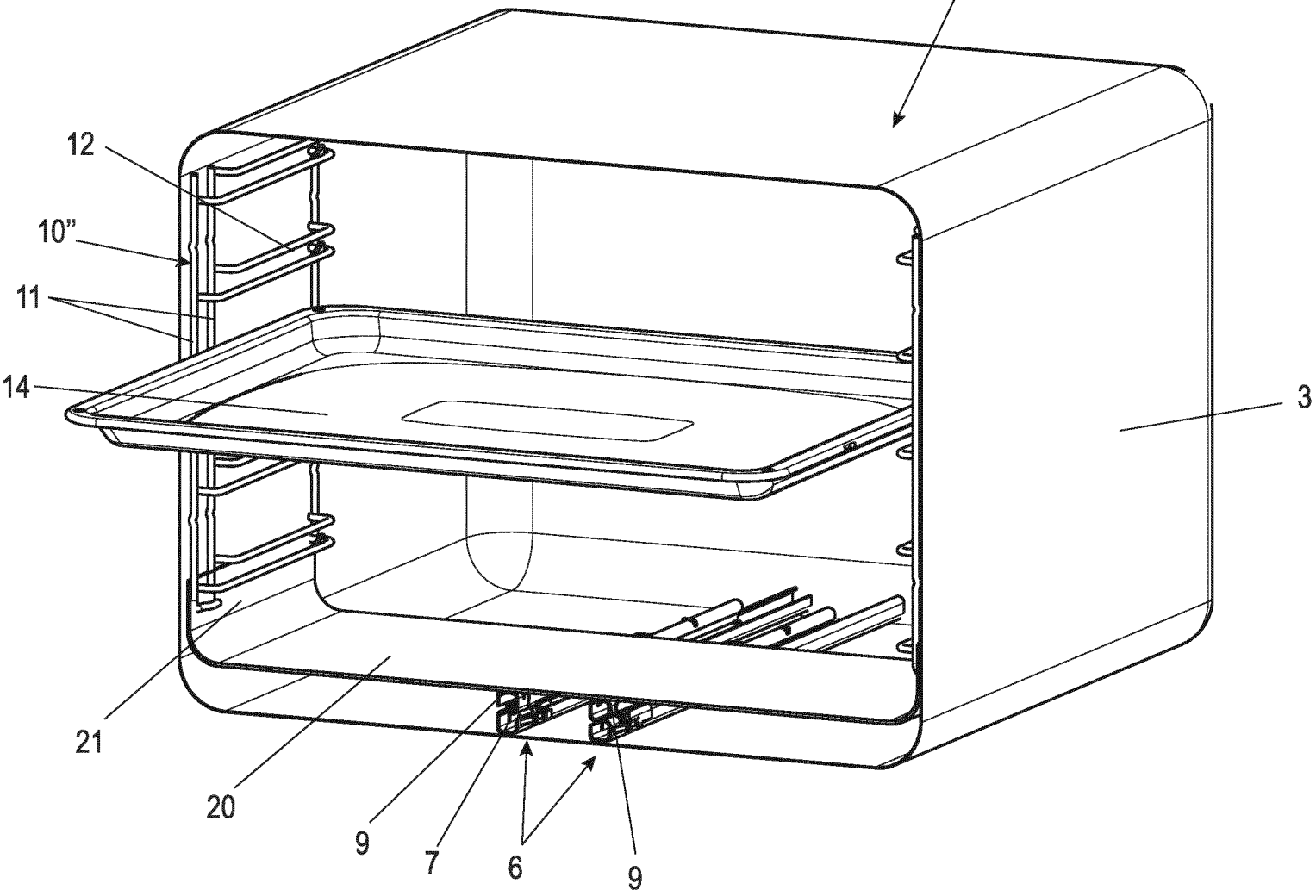

FIGS. 1A and 1B two views of an oven in the retracted position;

FIGS. 2A and 2B two views of the oven of FIG. 1 in a middle pull-out position;

FIG. 2C a detail of the oven of FIG. 1;

FIG. 2D a cooking good carrier according to the invention for use in an oven as shown in FIG. 1;

FIGS. 3A and 3B two views of the oven of FIG. 1 in a maximum extension position;

FIGS. 4A and 4B two views of an oven according to another design in a middle pull-out position;

FIG. 5 a view of an oven according to another design example, and

Figure 6:
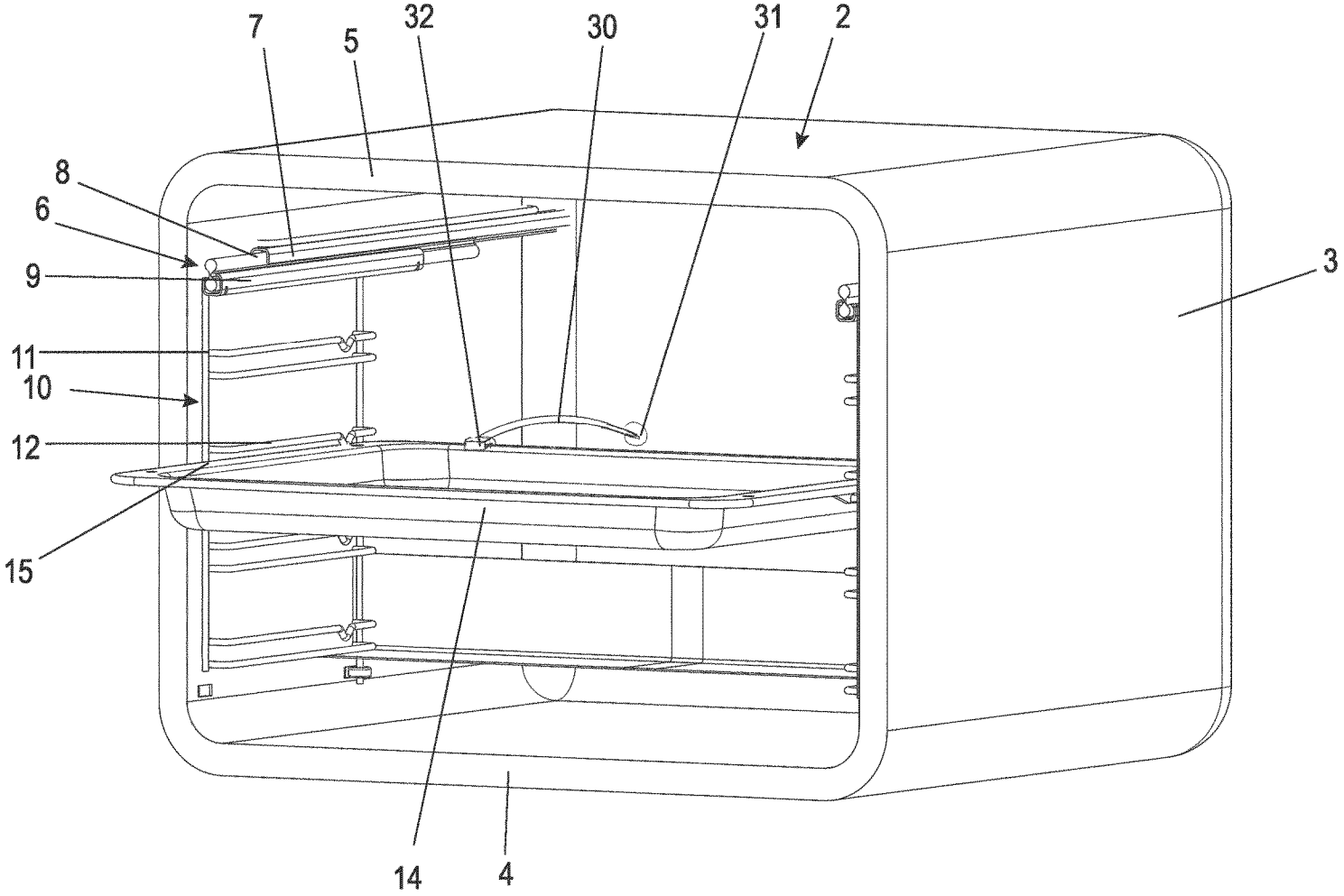

FIG. 6 a perspective view of an oven according to a modified design example.

DETAILED DESCRIPTION OF THE INVENTION

A baking oven 1 comprises a baking oven muffle 2, which has two side walls 3, which are connected to each other by a bottom 4 and a ceiling 5. In an interior of the baking oven muffle 2, there is a pull-out guide 6 on each side wall 3, which is fixed to the side wall 3 or the ceiling 5 with a stationary guide rail 7. On the guide rail 7, a pull-out-extending middle rail 8 is movably mounted, on which a running rail 9 can be moved, the movable bearing being preferably provided by rolling elements. In the longitudinal direction of the pull-out guide 6, the running rail 9 is designed to be shorter than the guide rail 7 and the middle rail 8, in particular by more than 10%, preferably by more than 20%.

A side grid 10 is held to the running rail 9, which has vertical posts 11 between which horizontal rods 12 run. The side grid 10 can be attached to the running rail 9 in a non-detachable way, e.g. by welding, or detachable, e.g. by clips, locking devices, screws or other detachable fasteners. Two horizontal rods 12 form a receptacle for an edge 15 of a cooking good carrier 14, which in the design example shown is designed as a baking tray, whereby grids or other cooking good carriers can also be used. The rods 12 are angled at one end section 13 so that, in a front view as shown in FIG. 1B, an edge 15 of cooking good carrier 14 can be inserted between two horizontal rods 12. The upper horizontal rod 12 of a support has a downward projection 16 in the rear area, in particular a V-shaped projection, which forms an anti-tip device and prevents the cooking good carrier from tipping upwards in the rear area if it is loaded at a front side. Instead of the projection 16, other holding devices can be provided for additional fixing of the cooking good carrier.

FIG. 2C shows that the cooking good carrier 14 has a downward protruding web or undercut 150 in the area of its edge 15, which, when the cooking good carrier 14 is correctly positioned in the side grid 10, rests against the angled front end section 13 of the lower rod 12 from both sides. The angled end section 13 is inserted in a receptacle 152 open at the bottom at the undercut 150. On the one hand, this ensures that the cooking good carrier 14 cannot be pushed too far into the side grid 10, and on the other hand it provides additional protection against tipping. The undercut 150 can have an insertion bevel 151 at least at the rear end area, which allows the cooking good carrier 14 to be easily pushed onto the rod. An insertion bevel 151 is preferably formed on both sides of the receptacle 152.

FIG. 2D shows a cooking good carrier 14 with undercut 150 and insertion bevels 151. The undercut 150 can be provided on opposite sides of the cooking good carrier 14.

The cooking good carrier 14 is longer than the side grid 10, particularly by at least 20%, preferably at least 30%, in the longitudinal direction of the pull-out guide 6. The running rail 9 is approximately the same length as the side grid 10, whereby the cooking good carrier 14 protrudes over the side grid 10 in a front area, whereas it is essentially flush with the side rail in the rear area.

In FIGS. 1A and 1B the cooking good carrier 14 is in a retracted position and the oven door can be closed.

If, when preparing food, access is required to part of cooking good carrier 14, it can be moved to a middle pull-out position as shown in FIGS. 2A and 2B. In this middle pull-out position, a front section of cooking good carrier 14, e.g. an area between 10 and 80%, is in front of the oven muffle 2 when viewed in the longitudinal direction of pull-out guide 6, while the remaining part of cooking good carrier 14 is located in the oven muffle 2, as shown in FIG. 2B. In this middle pull-out position, the side grid 10 is still completely in the oven muffle 2 and thus does not pose a risk of injury. If the cooking good carrier 14 is now removed from this middle pull-out position, the oven door can be closed even if the running rail 9 and the side grid 10 are not in the maximum pull-in position. Preferably, latching devices are provided on the pull-out guide 6 and/or the side grid 10 in order to be able to latch the cooking good carrier 14 together with the side grid 10 in the middle pull-out position and thus provide holding forces which prevent the cooking good carrier 14 from moving inadvertently beyond this middle pull-out position. In this embodiment, the latching means are designed as recesses 17 in the side wall 3 of the oven 1, in which a preferably spring-mounted roller 18 arranged on the vertical post 11 engages in the retracted, middle and extended positions. Instead of the recess 17 there could also be a detent projection or another detent element and instead of a roller 18 there could also be a projection, a spring element or similar latching means. Alternatively, latching means can be provided between guide rail 9 and guide rail 7 or between running rail 9 and side grid 10.

If the user wishes to move the cooking good carrier 14 further in front of the oven muffle 2, he can do so as shown in FIGS. 3A and 3B. By pulling the cooking good carrier 14 slightly, the latching means are disengaged and the cooking good carrier 14 can be moved. In this position, the side grid 10 is also located largely in front of the oven muffle. If the cooking good carrier 14 is now removed, the side grid 10 and the running rail 9 protrude relatively little from the oven muffle 2. For example, the side grid 10 can have a length in the longitudinal direction of the pull-out guide 6 between 20% and 60% of the length of the cooking good carrier 14. The cooking good carrier and side rack can be located completely in front of the oven muffle.

In the embodiment shown, the side grids 10 comprise a large number of horizontal rods 12, each of which forms receptacles for a cooking good carrier 14. It is of course possible to adapt and vary the number of so formed supports to the type of oven. In addition, the pull-out guide 6 can also be positioned to the side of the side grid or below the side grid 10 instead of above the side grid 10.

In order to increase the stability of an oven 1 according to the invention, at least one synchronizing means 19, e.g. as a sheet or as a rod, can be arranged between the right and left side grid 10. The at least one synchronizing means 19 is preferably located in an area of the side grid 10 which is vertically spaced from the pull-out guide 6. Additionally or alternatively, the two pull-out guides can also be connected to each other. Detachable or non-detachable fastening means can be provided for the synchronizing means 19.

FIGS. 4A and 4B show a modified embodiment of an oven 1 with an oven muffle 2. In the interior of the baking oven muffle 2, a pull-out guide 6 is located on each side wall 3, with a stationary guide rail 7 arranged below a movable running rail 9. The running rail 9 can be shorter than the guide rail 7 in the longitudinal direction of the pull-out guide 6. A modified side grid 10' is held to the running rail 9, which has vertical posts 11 and horizontal rods 12.

The side grid 10' has a profile 24 in the area of the pull-out guide 6, in particular a U-shaped profile 24 on which a support 25 is formed. This means that the support 25 can be supported on the running rail 9, so that additional fastening of the side grid 10', as is required for a suspended arrangement on an underside of the pull-out guide 6, is not necessary. The support 25 can be placed loosely on the running rail 9, whereby optional fixing is of course possible. The fixing can be either detachable, e.g. by clipping or screwing, or non-detachable, e.g. by welding.

To secure the cooking good carrier 14 to the side grid 10', it has an upwardly directed projection 26 on the lower horizontal rod 12 of each of the two horizontal rods 12, between which an edge 15 of the cooking good carrier 14 is held, which engages from below in a corresponding recess 27 on the edge 15 of the cooking good carrier 14. Instead of a projection 26, there may also be a pin or embossing.

FIG. 5 shows a further embodiment of an oven 1 with an oven muffle 2, in which two pull-out guides 6 are provided at the bottom of the oven muffle 2. It is also possible to use only one pull-out guide 6 instead of the two pull-out guides 6, which then carries two side grids 10".

The pull-out guide 6 support a support 20, which supports a side grid 10" on opposite sides. The support 20 has two upwardly projecting legs 21 for this purpose, although other designs of the support 20 can also be provided for fixing the side grids 10".

For the latter two embodiments, all the features described in detail for the first embodiment are also valid with regard to rail lengths, cooking good carrier and side grid positions, latching elements and synchronization means.

Each of the illustrated pull-out guides 6 can have a cover element not shown in the rear area of the guide rail. The cover protects the inside of the pull-out guide 6 from contamination and serves as a stop for the running rail 9 when retracted.

FIG. 6 shows the oven shown in FIGS. 1 to 3 in a modified design. In addition to the embodiments described above, a spring element 30 in the form of a bending spring is arranged between the oven muffle 2 and the cooking good carrier 14. The spring element 30 is connected to the oven muffle at one end 31, e.g. by a holder. At the opposite end, a connecting piece 32 is provided which rests on the cooking good carrier 14 and is detachably connected to the cooking good carrier 14. The spring element 30 allows the cooking good carrier 14 to be moved automatically in the opening direction from the closed position shown in FIG. 1A when the oven door is opened. The travel movement generated by spring element 30 facilitates access to the cooking good carrier 14. Starting from this position, the cooking good carrier 14 can then be moved further in the pull-out direction or moved again in the closing direction either directly or via the oven door.

The spring element 30 is located between a back wall of the oven muffle 2 and the cooking good carrier 14. Alternatively, the spring element 30 can also be provided between the oven muffle 2 and the side grid 10 or between the guide rail 7 and the running rail 9. In any case, the cooking good carrier 14 is directly or indirectly pretensioned in the opening direction via the spring element 30, whereby in the closed position the oven door holds the cooking good carrier 14 in the draw-in position. At a contact area between the cooking good carrier 14 and the oven door, an elastic stop element can be provided, e.g. at the edge 15, in order to avoid stop noises.

LIST OF REFERENCE SIGNS

1 Oven
2 Oven muffle
3 Side wall
4 Bottom
5 Ceiling
6 Pull-out guide
7 Guide rail
8 Middle rail
9 Running rail
10, 10', 10" Side grids
11 Post
12 Rod
13 End section
14 Cooking good carrier
15 Edge
150 Undercut
151 Insertion bevel
152 Receptacle
16 Projection

17 Recess
18 Roller
19 Synchronizing means
20 Support
21 Leg
24 Profile
25 Support
26 Projection
27 Recess
30 Spring element
31 End
32 Connecting piece

What is claimed is:

1. A baking oven (1) comprising:

a baking oven muffle (2), at least one pull-out guide (6) connected to the baking oven muffle (2), the at least one pull-out guide (6) having a stationary guide rail (7) and a movable running rail (9), wherein the stationary guide rail (7) is arranged entirely above the movable running rail (9);

two side grids, arranged one each on opposite sides of the baking oven muffle, wherein one or two of the side grids (10, 10', 10") are held on the movable running rail (9) of the at least one pull-out guide, and a cooking good carrier (14) arranged between the two side grids (10, 10', 10") and configured for connection to at least one receptacle on at least one of the side grids, wherein the side grids (10, 10', 10") are shorter than the cooking good carrier (14) in a direction parallel to a longitudinal direction of the pull-out guides (6), wherein the cooking good carrier (14) is configured to be arranged in a maximum pull-out position with a front section projecting from the baking oven muffle (2), while the two side grids (10, 10' 10") are still arranged completely in the baking oven muffle, wherein in a maximum extension position of the pull-out guide (6) a front end of the running rail (9) is arranged inside the baking oven muffle (2), wherein the cooking good carrier (14) is designed to be at least 20% longer in the longitudinal direction than the side grids (10, 10', 10"), wherein each side grid (10, 10', 10") has at least two horizontal rods (12) between which an edge (15) of the cooking good carrier (14) is held, and a vertical post between which the horizontal rods run, wherein the cooking good carrier is held on opposite sides by the side grids, and wherein the side grids are supported by the pull-out guide (6).

2. The baking oven according to claim 1, wherein the cooking good carrier (14) is configured to be arranged in a middle pull-out position with a front section projecting from the baking oven muffle (2), while the two side grids (10, 10', 10") are still arranged completely in the baking oven muffle.

3. The baking oven according to claim 1, wherein latching means are provided which latch the side grids (10, 10', 10") in a maximum pull-out position and/or in a middle pull-out position between a pull-in position and the maximum pull-out position.

4. The baking oven according to claim 1, wherein at least one of the side grids (10, 10', 10") is arranged on at least one side hanging or standing on the at least one pull-out guide (6).

5. The baking oven according to claim 1, wherein the at least one pull-out guide (6) is arranged on a bottom (4) of the baking oven muffle (2), and supports both side grids (10"), by means of a support (20).

6. The baking oven according to claim 1, wherein a pull-out-extending middle rail (8) is arranged between the stationary guide rail (7) and the running rail (9).

7. The baking oven according to claim 1, wherein the side grids (10, 10', 10") and/or the running rails (9) of the pull-out guide (6) are connected to one another via a synchronizing means.

8. The baking oven according to claim 1, wherein a projection (16, 26) or a supporting element for fixing the cooking good carrier (14) in a tilt-proof manner is formed on a rod (12) of a receptacle for an edge (15) of a cooking good carrier (14).

9. The baking oven according to claim 1, wherein an undercut (150) is arranged on at least one edge (15) of the cooking good carrier (14), which undercut (150) rests against a front angled end section (13) of at least one of the rods (12) when the cooking good carrier (14) is inserted into one of the side grids (10).

10. The baking oven according to claim 1, wherein the running rail (9) is at least 10% shorter than the guide rail (7) of the pull-out guide (6).

11. The baking oven according to claim 1, wherein in a middle pull-out position of the pull-out guide (6) a front end of the running rail (9) is arranged inside the baking oven muffle (2).

12. The baking oven according to claim 1, wherein at least one spring element (30) is provided between the baking oven muffle (2) and the cooking good carrier (14), which spring element (30) prestresses the cooking good carrier (14) in an opening direction in a closed position of the baking oven (1).

13. The baking oven according to claim 12, wherein the spring element (30) engages releasably or non-detachably with a synchronizing means or with a side grid (10, 10', 10").

14. The baking oven according to claim 1, wherein at least one stop element made of an elastic material is provided on the cooking good carrier (14) on a side facing the oven door.

15. A baking oven (1) comprising:

a baking oven muffle (2), at least one pull-out guide (6) connected to the baking oven muffle (2), the at least one pull-out guide (6) having a stationary guide rail (7) and a movable running rail (9), wherein the stationary guide rail (7) is arranged entirely below the movable running rail (9);

two side grids, arranged one each on opposite sides of the baking oven muffle, wherein one or two of the side grids (10, 10', 10") are held on the movable running rail (9) of the at least one pull-out guide, and a cooking good carrier (14) arranged between the two side grids (10, 10', 10") and configured for connection to at least one receptacle on at least one of the side grids, wherein the side grids (10, 10', 10") are shorter than the cooking good carrier (14) in a direction parallel to a longitudinal direction of the pull-out guides (6), wherein the cooking good carrier (14) is configured to be arranged in a maximum pull-out position with a front section projecting from the baking oven muffle (2), while the two side grids (10, 10', 10") are still arranged completely in the baking oven muffle, wherein in a maximum extension position of the pull-out guide (6) a front end of the running rail (9) is arranged inside the baking oven muffle (2), wherein the cooking good carrier (14) is designed to be at least 20 % longer in the longitudinal direction than the side grids (10, 10', 10"), wherein each side grid (10, 10', 10") has at least two horizontal rods (12) between which an edge (15) of the cooking good carrier (14) is held, and a vertical post between which the horizontal rods run, wherein the cooking good carrier is held on opposite sides by the side grids, and wherein the side grids are supported by the pull-out guide (6).

* * * * *